US009359922B2

(12) United States Patent
Haubner

(10) Patent No.: US 9,359,922 B2
(45) Date of Patent: Jun. 7, 2016

(54) VALVE CONTROL MEANS FOR AN INTERNAL COMBUSTION ENGINE AND INTERNAL COMBUSTION ENGINE

(71) Applicant: FEV GmbH, Aachen (DE)

(72) Inventor: Frank Haubner, Aachen (DE)

(73) Assignee: FEV GmbH, Aachen (DE)

( * ) Notice: Subject to any disclaimer, the term of this patent is extended or adjusted under 35 U.S.C. 154(b) by 161 days.

(21) Appl. No.: 14/472,285

(22) Filed: Aug. 28, 2014

(65) Prior Publication Data

US 2015/0059672 A1 Mar. 5, 2015

(30) Foreign Application Priority Data

Aug. 29, 2013 (DE) ..... 10 2013 109 414

(51) Int. Cl.

| | |
|---|---|
| ***F01L 1/34*** | (2006.01) |
| ***F01L 13/00*** | (2006.01) |
| ***F01L 1/18*** | (2006.01) |
| ***F01L 1/08*** | (2006.01) |
| ***F01L 1/24*** | (2006.01) |
| ***F01L 1/30*** | (2006.01) |

(52) U.S. Cl.

CPC ..... *F01L 13/0026* (2013.01); *F01L 1/08* (2013.01); *F01L 1/18* (2013.01); *F01L 1/2416* (2013.01); *F01L 1/30* (2013.01); *F01L 13/0063* (2013.01); *F01L 2105/00* (2013.01)

(58) Field of Classification Search

CPC ..... F01L 13/0026; F01L 1/18; F01L 1/08; F01L 1/30; F01L 13/0063; F01L 1/2416; F01L 2105/00

USPC ..... 123/90.16

See application file for complete search history.

(56) References Cited

U.S. PATENT DOCUMENTS 7,367,298 B2 * 5/2008 Meyer ..... F01L 13/0063 123/90.15

FOREIGN PATENT DOCUMENTS

| | | |
|---|---|---|
| DE | 1 099 264 | 11/1959 |
| DE | 101 40 635 A1 | 4/2003 |

* cited by examiner

*Primary Examiner* — Zelalem Eshete

(74) *Attorney, Agent, or Firm* — Intellectual Property Law Group LLP

(57) ABSTRACT

The invention relates to a valve control means (1) for an internal combustion engine, having two cams (2, 3) which are arranged one behind another on a camshaft (20), the cams (2, 3) having different cam contours, a drag lever system (4), having a first lever (5), a second lever (7) which is connected to the first lever (5) such that it can be rotated about a pivot point (6), and a third lever (8) which is connected fixedly to the first lever (5), the first lever (5) having a roller pickup (15) for a first cam (2) and the second lever (7) having a roller pickup (17) for the second cam (3), the third lever (8) having a slotted guide (9) for the rectilinear positive guidance of a valve (30), the drag lever system (4) being mounted at the pivot point (6) such that it can be adjusted on a circular path (10) about the rotational axis (21) of the camshaft (20) in a cylinder block or cylinder head of the internal combustion engine, and having a play compensation element (11) between the second lever (7) and the first lever (5) or the third lever (8) for play compensation and for limiting the rotatability of the second lever (7) with respect to the first lever (5) and the third lever (8). Furthermore, the invention relates to an internal combustion engine, having at least one valve control means of this type.

20 Claims, 1 Drawing Sheet

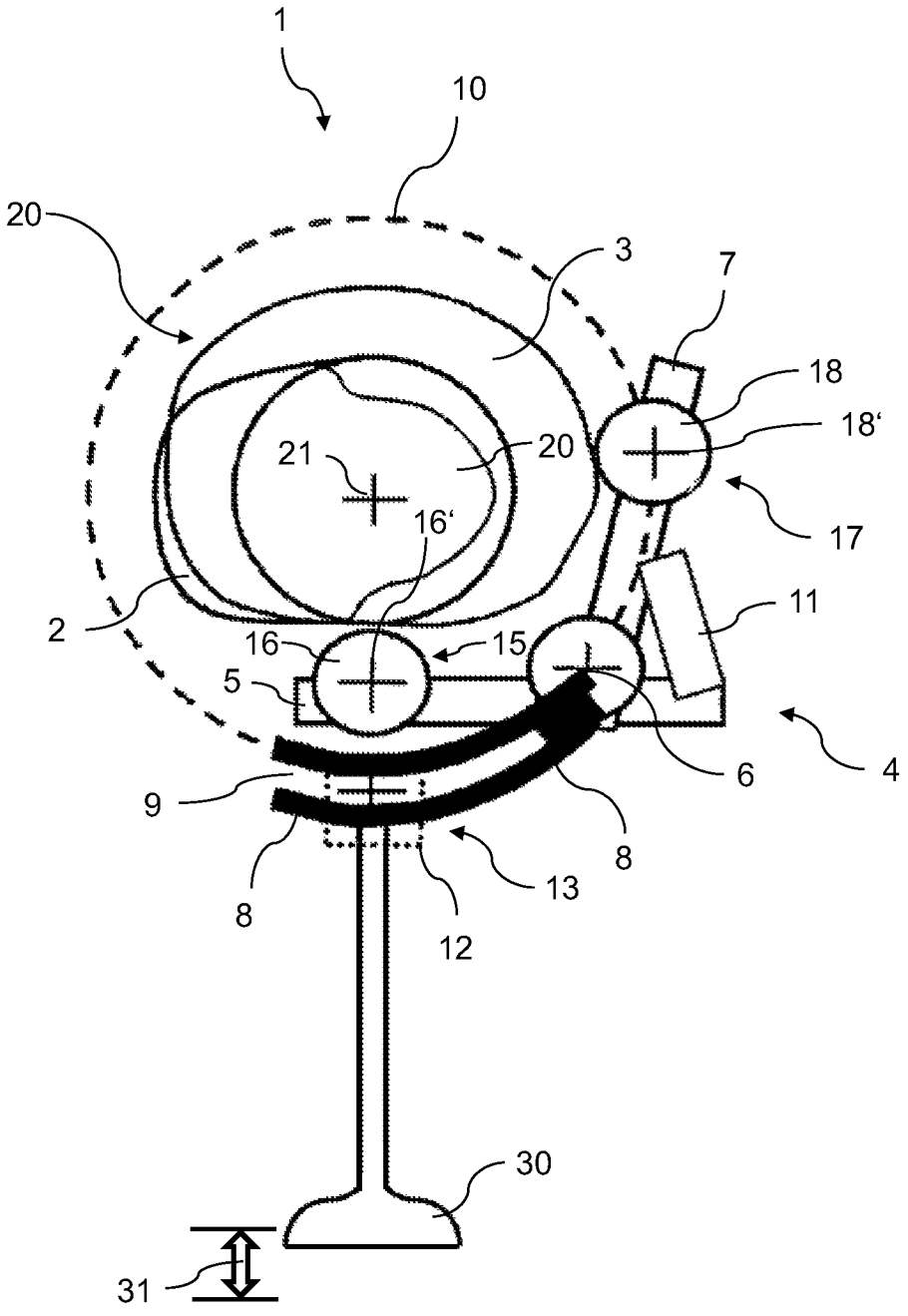
1
10
20
3
7
18
18'
21
20
16'
17
2
11
16
15
5
6
4
9
8
13
8
12
30
31

VALVE CONTROL MEANS FOR AN INTERNAL COMBUSTION ENGINE AND INTERNAL COMBUSTION ENGINE

CROSS-REFERENCE TO RELATED APPLICATION

This application claims priority to German application no. 10 2013 109 414.7 filed on Aug. 29, 2013, which his hereby incorporated by reference in its entirety.

BACKGROUND

1. Field of the Invention

The present invention relates to a valve control means for an internal combustion engine and to an internal combustion engine.

2. Background Art

Modern combustion engines using spark ignition combustion processes afford potential for reducing the fuel consumption by way of a reduction of the gas exchange losses. To this end, dethrottling of the engine is an expedient way. There is already a multiplicity of systems for variable or fully variable valve control on the market.

DE 101 40 635 A1 discloses a valve train apparatus for the independent variable lift adjustment of the gas exchange valves of an internal combustion engine, in which valve train apparatus the gas exchange valves are actuated by way of additional rocker arms which are positioned by way of independent adjusting bars and are moved by way of a camshaft in a slotted guide track which is fixed to the machine. Here, a rocker arm rolls in the slotted guide track by way of a mounted roller and at the same time rolls along the contour of an adjusting bar on a second roller which is mounted in the lever. Opposite the slotted guide roller, the rocker arm has a work curve which runs on the roller of a roller drag lever which is preferably mounted on a hydraulically actuated play compensation element. In order to set a valve lift, the adjusting bar is positioned or regulated in a guide in accordance with a torque request. In DE 101 40 635 A1, in particular, the roller drag lever is driven by way of a further rocker arm which, during a rotation of the camshaft, is moved by way of a roller along a trajectory which is defined by a slotted guide which is fixed to the housing.

U.S. Pat. No. 1,099,264 discloses a valve control means for high speed internal combustion engines, in which valve control means the opening movement of a valve is achieved by way of a drag lever which interacts with a cam and the closing movement takes place by way of double-armed levers which act on the valve and interact with cam disks, the cam disks being arranged coaxially with respect to the cam in a manner known per se, and the double-armed levers being mounted on both sides of the drag lever substantially coaxially with respect to said drag lever and with respect to one another. Positive guidance of the valve takes place by way of said valve control means. All the levers are mounted on a common axis. The levers are not coupled to one another.

The fully variable systems which are in use are all very complicated. Furthermore, the systems tend to be heavy as a result of the multiplicity of components and require a corresponding design of the valve springs with high spring forces. This usually leads to high frictional losses.

SUMMARY OF THE INVENTION

It is an object of the invention to provide a simple and lightweight valve control means for an internal combustion engine and an internal combustion engine with a relatively small installation space requirement and low frictional losses, which additionally makes variability, in particular full variability, of the valve lift of a valve possible.

The above object is achieved according to the invention by way of a valve control means for an internal combustion engine having the features of independent claim 1 and by way of an internal combustion engine having the features of claim 11. Further features and details of the invention result from the subclaims, the description and the drawings. Here, it goes without saying that features and details which are described in conjunction with the valve control means according to the invention also apply in conjunction with the internal combustion engine according to the invention and vice versa in each case, with the result that reference is always made or can always be made reciprocally with regard to the disclosure with respect to the individual aspects of the invention.

The object of the invention is achieved by way of a valve control means for an internal combustion engine, having two cams which are arranged one behind another on a camshaft, the cams having different cam contours. Furthermore, the valve control means is distinguished by a drag lever system which has a first lever, a second lever which is connected to the first lever such that it can be rotated about a pivot point, and a third lever which is connected fixedly to the first lever. The first lever has a roller pickup for a first cam, the second lever has a roller pickup for the second cam, and the third lever has a slotted guide for the rectilinear positive guidance of a valve. The drag lever system is mounted at the pivot point such that it can be adjusted on a circular path about the rotational axis of the camshaft in a cylinder block or cylinder head of the internal combustion engine. Furthermore, the valve control means has a play compensation element between the second lever and the first or the third lever for play compensation and for limiting the rotatability of the second lever with respect to the first lever and the third lever.

A valve control means which is configured in this way for an internal combustion engine is of structurally simple and lightweight configuration and requires a small installation space requirement. Furthermore, a valve control means of this type can keep frictional losses low and makes variability, in particular full variability, of the valve lift of a valve possible. That is to say, the valve lift of the valve can be changed by way of a change of the drag lever system. Depending on the requirement, the valve lift of the valve can be set, all other components of the valve control means remaining unchanged. The drag lever system of the valve control means is preferably configured in such a way that the valve lift of the valve can be changed in a fully variable manner by way of an adjustment of the drag lever system on a circular path.

The valve control means has two cams. They are arranged parallel to one another on a camshaft. The cams are preferably in contact with one another. The cams have different cam contours and are configured and arranged with respect to one another in such a way that, during a rotation, the first cam makes rectilinear displacement of the valve in a first direction possible and the second cam subsequently makes displacement of the valve in a second direction possible, the second direction being opposed to the first direction. The first cam preferably makes opening of the valve possible and the second cam makes closing of the valve possible. The cams are configured, in particular, in such a way that they are operatively connected alternately to the valve. That is to say, as long as the valve is in an operative connection with the first cam, there is no operative connection of the valve to the second cam and vice versa. The operative connection of the cam to the valve is realized via the drag lever system. This has three levers. The first lever is connected to the first cam. For this purpose, the first lever has a roller pickup. The second lever of the drag lever system is connected to the second cam. For this purpose, the second lever likewise has a roller pickup. The roller pickups ensure very low frictional losses during the actuation of the valve control means. The first lever and the second lever are connected to one another such that they can be rotated slightly at a pivot point. The drag lever system is mounted adjustably at the pivot point in a cylinder block or cylinder head of the internal combustion engine. The mounting of the drag lever system or the pivot point of the drag lever system is variable. The drag lever system can thus be displaced at its pivot point on a circular path which runs about the rotational axis of the camshaft. The valve lift of the valve can be changed by way of a change of the mounting of the drag lever system on the circular path. That is to say the valve lift of the valve can be set according to requirements by way of the displaceability of the drag lever system, all other components of the valve control means remaining unchanged. A sliding pickup can also optionally be provided instead of the roller pickup. Although this would have disadvantages with regard to friction which is produced, it would nevertheless be an alternative technical solution from the aspect of cost and weight reduction. The same applies to the second lever or the roller pickup of the second lever. A sliding pickup might in principle also be used here.

In the context of the invention, a roller pickup is a roller which is mounted rotatably on a lever. In the valve control means according to the invention, a roller is advantageously situated at that end of the first lever which is remote from the pivot point of the first lever. Furthermore, the second lever also has a roller which is mounted rotatably at the free end of the second lever as roller pickup. By way of the respective roller pickups, the first lever can follow the first cam and the second lever can follow the second cam. By way of the roller pickups on the levers, frictional losses can be reduced and at the same time the load-bearing capability of the valve control means can be increased. That is to say, an improvement in the wear behavior results in the case of the levers with a roller pickup. In the case of a sliding pickup, a tribologically appropriate design can be suitable, that is to say the provision of tribologically favorable surfaces, materials and coatings and lubrication conditions, in order to maintain wear rates which are customary and required for the service life of the engine. This tribological optimization would also have the minimization of friction as its target.

The third lever has a slotted guide for the rectilinear positive guidance of the valve. Here, the third lever is connected fixedly, that is to say unchangeably, to the first lever. The valve or one end of the valve is guided in the slotted guide with a very small play. That is to say, the slotted guide of the third lever is preferably configured in such a way that the valve can be guided in the slotted guide with a small play. During a movement of the first lever on account of the roller pickup of the first lever rolling on the first cam, the first lever and therefore the drag lever system are pivoted about the pivot point of the drag lever system. That is to say, by way of a movement of the first lever in the direction of the valve, the valve is moved away from the camshaft and is therefore opened. Here, the valve or one end of the valve slides along in the slotted guide of the third lever. Here, the valve itself is moved rectilinearly.

A play compensation element is arranged between the second lever and the first lever or the third lever and is connected to them.

The first and the third lever are connected fixedly to one another, that is to say such that they are not adjustable or rotatable with respect to one another. The first and the third lever can be configured in two pieces. It is also conceivable that the first lever and the third lever are configured in one piece, in particular are configured monolithically, that is to say are manufactured from one part. It is advantageous if the combination of first and third lever is not too heavy because the drag lever system, as a dynamically moving part, should be as lightweight as possible. In contrast, the second lever can be rotated with respect to the combination of first and third lever, but in a manner which is limited by way of the play compensation element which is advantageously a hydraulic play compensation element.

The drag lever system can therefore be considered to be substantially rigid per se and can be rotated about the pivot point which can be arranged adjustably on the circular path. The play compensation element permits merely the play compensation of the second lever with respect to the combination of first and third lever and therefore between the cams and the valve.

A valve control means is preferred, in which the cams and the drag lever system are configured and adapted to one another in such a way that, in order to open the valve, the valve can be moved away from the camshaft by way of the first cam and the drag lever system and, in order to close the valve, can be moved back in the direction of the camshaft by way of the second cam and the drag lever system.

For the closed valve, the first cam and the lever with roller pickup have a small play with respect to one another when the valve is in the closed position. The force which is required for closing is therefore transmitted from the second cam via the second lever and the compensation element into the first lever. Since said lever is operatively connected to the valve via the third lever and the movement of the first and third lever is not restricted, the first lever and the second cam can perform a movement which leads to closure of the valve. The compensation element transmits a force which is suitable for this purpose, in order to keep the valve in the closed position. To this end, a hydraulic actuation means may be suitable. It can therefore be provided in a valve control means that the roller pickup of the first lever has a roller, and that the first lever and the first cam can be arranged with respect to one another in such a way that there is a small play between the roller and the first cam. In conjunction with the closing force of the compensation element, this ensures that the valve remains closed. The closing force of the compensation element and the play are therefore adapted to one another in such a way that the valve remains closed.

That is to say, if the roller pickup of the first lever is gripped by the first cam and is moved downward, the third lever which is connected rigidly to the first lever also moves downward and, as a result, opens the valve to the combustion chamber of the internal combustion engine. Together with the first cam, the first lever makes the opening of the valve possible. The roller pickup of the second lever on the second cam is free during the engagement of the roller pickup of the first lever on the first cam. The associated cam contour of the second cam allows for this requirement. In the reverse case, the roller pickup of the first lever is free from the first cam when the roller pickup of the second lever and therefore the second lever are deflected by the second cam. By means of the largely rigid drag lever system, the valve can be moved upward and therefore the valve can be closed. In order that the valve remains closed completely, the play compensation element, in particular the hydraulic play compensation element, ensures play compensation. Without said play compensation, the closure point of the valve in the seat would be over-determined and therefore associated either with high forces in the system or with the valve staying open.

If the pivot point is adjusted on the circular path about the rotational axis of the camshaft in the direction of the valve, that is to say in the direction of the guided end of the valve, the valve lift is reduced, since the valve or the guided end of the valve passes closer to the pivot point of the drag lever system and therefore the spacing of the pivot point from the point, where the valve is guided in the slotted guide of the third lever, is shortened with an identical adjusting angle. In the reverse case, in the case of a greater spacing of the pivot point of the drag lever system from the point, where the valve is guided in the slotted guide of the third lever, the valve lift becomes correspondingly greater. In order to adjust the drag lever system on the circular path about the camshaft, the valve control means can have an actuator.

Since the roller pickups of the first and the second lever are likewise rotated with respect to the camshaft during an adjustment of the pivot point of the drag lever system on the circular path, the opening and closure points of the valve change with a changed lift of the valve. It is therefore advantageously provided in a valve control means according to the invention that the latter has a variable valve closing and opening time setting apparatus.

According to one preferred development of the invention, it can be provided in a valve control means that the driver is held guidably in the slotted guide, to which driver the valve can be fastened. In order to guide the valve, the driver can be fastened, in particular in a rotationally movable manner, to the valve, in particular to the free end of the valve. It is also conceivable that the driver is configured in one piece with the valve.

The third lever of the drag lever system has a slotted guide for the rectilinear positive guidance of the valve. The slotted guide can be of different configurations. Here, the slotted guide and the drag lever system are configured and adapted to one another in such a way that a pivoting movement of the drag lever system and therefore of the third lever leads to a linear movement of the valve. It can advantageously be provided in a valve control means that the third lever is configured as a forked lever. In an embodiment of this type of the third lever, the valve, in particular the driver of the valve, is guided between the forks of the forked lever with a small play.

BRIEF DESCRIPTION OF THE DRAWINGS

In the following text, the invention and its advantages will be explained in greater detail using the drawings, in which, diagrammatically:

FIG. 1 shows a valve control means according to the invention.

DETAILED DESCRIPTION OF SPECIFIC EMBODIMENTS

FIG. 1 diagrammatically shows a valve control means 1 according to the invention. The valve control means 1 for an internal combustion engine has two cams 2, 3 which are arranged one behind another on the camshaft 20. The two cams 2, 3 have different cam contours. Furthermore, the valve control means 1 has a drag lever system 4. The latter is distinguished by three levers 5, 7, 8. The first lever 5 and the second lever 7 are connected rigidly to one another and are mounted such that they can be rotated about a pivot point 6. The pivot point 6 of the drag lever system 4 and therefore the drag lever system 4 can be mounted such that they can be adjusted on a circular path 10 about the rotational axis 21 of the camshaft 20 in the cylinder block or cylinder head of the internal combustion engine. That is to say, by way of a change of the mounting of the pivot point 6 of the drag lever system 4 on the circular path 10, the valve lift 31 of the valve 30 can be changed. Depending on the requirement of the internal combustion engine, the valve lift 31 of the valve 30 can be set by way of the variable mounting of the drag lever system 4 on the circular path 10.

The third lever 8 of the drag lever system 4 is connected rigidly to the first lever 5. The connection can be non-positive or material-to-material. It is also conceivable that the first lever 5 and the third lever 8 are in one piece, in particular are manufactured monolithically. The third lever 8 has a slotted guide 9 for the rectilinear positive guidance of the valve 30. The slotted guide 9 can be any type of guide. The third lever 8 is preferably configured as a forked lever, as shown in FIG. 1. The forks of the forked lever form the slotted guide 9 between them for the valve 30. A driver 12 is fastened rotatably to the valve 30, via which driver 12 the valve 30 is guided in the slotted guide 9 of the third lever 8 with a small play.

The valve control means 2 has a play compensation element 11 between the second lever 7 and the first lever 5 or the third lever 8 for play compensation and for limiting the rotatability of the second lever 7 with respect to the first lever 5 and the third lever 8. That is to say, the play compensation element 11 permits merely play compensation of the second lever 7 with respect to the combination of first and third lever 5, 8 and therefore between the cams 2, 3 and the valve 30. In order that the valve 30 remains completely closed and the closure point of the valve 30 in the seat is not over-determined, the play compensation element 11 which is configured, in particular, as a hydraulic play compensation element ensures play compensation. Without said play compensation, the closure point of the valve 30 in the seat would be associated either with high forces or with the valve staying open.

Designation 21 represents the axis of the camshaft 20. This can be the inlet and outlet side of the camshaft 20. The pivot point 6 of the drag lever system 4 is situated at a constant spacing from the axis 21, that is to say the mounting of the drag lever system 4 and therefore the pivot point of the first lever 5 and the second lever 7 which in each case have a roller 16, 18 for opening and closing the valve 30. The first lever 5, also called opening lever, is actuated by way of the contour of a cam 2 via the roller 16, mounted at the point 16' on the first lever 5. Here, the spacing of the pivot point 16' of the roller 16 from the pivot point 6 of the first lever 5 is constant. The first lever 5 is connected directly to the third lever 8 and therefore to the slotted guide 9 of the third lever 8, that is to say both levers 5, 8 perform an identical angular change about the pivot point 6 of the first lever 5 upon actuation. A driver 12 which can move in the slotted guide 9 is situated in or on the third lever 8. Said driver 12 has a receptacle for the valve 30. By way of said receptacle, the driver 12 can move the valve 30 both in the direction of the combustion chamber of the internal combustion engine (not shown) and also in the direction of the camshaft 20. The driver 12 and valve 30 therefore jointly perform a translatory movement in the vertical direction, that is to say in the direction of the valve axis. The driver 12 permits a rotation of the valve 30. Furthermore, the driver 12 permits a relative angular change as a result of suitable shaping in contact with the slotted guide 9 and likewise performs the required sliding movement in the slotted guide 9. This is achieved by way of a linear contact between the driver 12 and slotted guide 9. Relative movements of this type are customary in current valve drive means, for example on drag levers with a sliding pickup. Customary materials can therefore be used. The valve 30 is closed in a positively controlled manner via the second lever 7, what is known as the closure lever. The latter is deflected via the corresponding cam contour of the second cam 3 and performs a rotational movement about the pivot point 6. Here, the roller 18, mounted at the pivot point 18' on the second lever 7, is in contact with the corresponding cam contour of the second cam 3. At the same time, the cam contour of the second cam 3 releases the actuation of the valve 30 via the second lever 7 to such an extent that the second lever 7 can deflect and can actuate the first lever 5 and the third lever 8 which is fastened thereto with the slotted guide 9 via the compensation element 11. As a result, the slotted guide 9 is restored to the position at the start of the valve actuation.

A suitable selection of the plays ensures that the second lever 7 holds the valve 30 in the closed state. A sufficient force in the play compensation element 11 which is preferably configured as a hydraulic play compensation element is required for this purpose, which force can be achieved or set via the position, the lever ratios and the oil pressure. The variability in the valve train means is then achieved by way of changing of the bearing position of the pivot point 6 of the drag lever system 4, that is to say by way of rotation of the pivot point 6 on the circular path 10 about the axis 21 of the camshaft 20. Since the pivot point 6 can be moved on the circular path 10, common mounting of the entire mechanism, that is to say of the camshaft 20 and the drag lever system 4, in the camshaft bearings may be suitable.

The first cam 2 and the roller 16 of the first lever 5 have a small play with respect to one another when the valve 30 is in the closed position. The force which is required for closing is therefore transmitted from the second cam 3 via the second lever 7 and the compensation element 11 into the first lever 5. Since said first lever 5 is operatively connected to the valve 30 via the third lever 8 and the movement of the first lever 5 and the third lever 8 is not restricted, the first lever 5 and the second cam 3 can perform a movement which leads to the closure of the valve 30.

It goes without saying that the internal combustion engine can have a plurality of valve control means 1 of this type. That is to say, all the valves 30 or the valve control means 1 of the cylinders which are arranged in line can take place on one shaft, that is to say the valves 30 are all adjusted jointly.

If the pivot point 6 of the drag lever system 4 is rotated/moved, for example, in the clockwise direction about the rotational axis 21 of the camshaft 20, the lift movement of the levers 5 and 7 takes place in an unchanged manner, but a changed phase position is produced. In this case, the valve 30 is actuated later. This change of the phase position can be compensated for additionally by way of early adjustment of a phase shifter. The combination of the valve control means 1 with a phase shifter is advantageous. Whether it is necessary depends on the design and the adjustment of the pivot point 6.

One possible alternative embodiment of the valve control means 1 comprises a completely pre-assembled unit which is inserted instead of the camshaft 20 into the camshaft bearings. Said unit might possibly be of shell-shaped configuration and accommodate all the required components including the levers 5, 7, 8, the pivot point 6 and the play compensation element 11. The camshaft 20 would be provided, for example, with antifriction bearings and would be mounted in said unit. At least one bearing would be required for the supply of oil and would accordingly be configured as a plain bearing. The shell-shaped unit would be likewise suitable to guide the oil for lubricating the levers 5, 7, 8 and for supplying the play compensation element 11 into the rotational axis 6. From there, the supply of the play compensation element 11 can take place by means of a simple system of bores. The driver 12 can both be inserted into the slotted guide 9 and then plugged and clipped onto the valve 30 during mounting or can already be installed onto the valve 30 and can then be introduced into the slotted guide 9. A suitable conical receptacle on the slotted guide 9 would be sufficient. The drag lever system 4 would also be capable of being implemented in a compact manner if rollers 16, 18 with a low weight are used. Overall, the actuating forces lie at a low level. The valve actuation therefore has the advantage of being capable of being used in a wide rotational speed range. For example, rotational speeds of up to 16 000 rpm can be realized with very large valves 30 and very high lift cams. These properties could also be combined with the fully variable valve control means 1 according to the invention. The valve control means 1 is maintenance-free as a result of the play compensation.

LIST OF DESIGNATIONS

1 Valve control means
2 First cam
3 Second cam
4 Drag lever system
5 First lever
6 Pivot point
7 Second lever
8 Third lever
9 Slotted guide
10 Circular path
11 Play compensation element
12 Driver
13 End of the valve
15 Roller pickup of the first lever
16 Roller
16' Pivot point of the roller
17 Roller pickup of the second lever
18 Roller
18' Pivot point of the roller
20 Camshaft
21 Rotational axis
30 Valve
31 Valve lift

What is claimed is:

1. A valve control means (1) for an internal combustion engine, having two cams (2, 3) which are arranged one behind another on a camshaft (20), the cams (2, 3) having different cam contours, a drag lever system (4), having a first lever (5), a second lever (7) which is connected to the first lever (5) such that it can be rotated about a pivot point (6), and a third lever (8) which is connected fixedly to the first lever (5), the first lever (5) having a roller pickup (15) for a first cam (2) and the second lever (7) having a roller pickup (17) for the second cam (3), the third lever (8) having a slotted guide (9) for the rectilinear positive guidance of a valve (30), the drag lever system (4) being mounted at the pivot point (6) such that it can be adjusted on a circular path (10) about the rotational axis (21) of the camshaft (20) in a cylinder block or cylinder head of the internal combustion engine, and having a play compensation element (11) between the second lever (7) and the first lever (5) or the third lever (8) for play compensation and for limiting the rotatability of the second lever (7) with respect to the first lever (5) and the third lever (8).

2. The valve control means (1) as claimed in claim 1, wherein the drag lever system (4) is configured in such a way that the valve lift of the valve (30) can be changed in a fully variable manner by way of an adjustment of the drag lever system (4) on a circular path (10).

3. The valve control means (1) as claimed in claim 1, wherein the cams (2, 3) and the drag lever system (4) are configured and adapted to one another in such a way that, in order to open the valve (30), the valve (30) can be moved away from the camshaft (20) by way of the first cam (2) and the drag lever system (4) and, in order to close the valve (30), can be moved back in the direction of the camshaft (20) by way of the second cam (3) and the drag lever system (4).

4. The valve control means (1) as claimed in claim 1, wherein the slotted guide (9) of the third lever (8) is configured in such a way that the valve (30) can be guided with a small play.

5. The valve control means (1) as claimed in claim 1, wherein a driver (12) is held guidably in the slotted guide (9), to which driver (12) the valve (30) can be fastened.

6. The valve control means (1) as claimed in claim 1, wherein the third lever (8) is configured as a forked lever.

7. The valve control means (1) as claimed in claim 1, wherein the first lever (5) and the third lever (8) are configured in one piece, in particular monolithically.

8. The valve control means (1) as claimed in claim 1, wherein the play compensation element (11) is a hydraulic play compensation element.

9. The valve control means (1) as claimed in claim 1, wherein the valve control means has a variable valve closing and opening time setting apparatus.

10. The valve control means (1) as claimed in claim 1, wherein the roller pickup (15) has a roller (16), and in that the lever (5) and the cam (2) can be arranged with respect to one another in such a way that there is a small play between the roller (16) and the cam (2).

11. An internal combustion engine, in particular for a motor vehicle, having at least one valve control means (1) having two cams (2, 3) which are arranged one behind another on a camshaft (20), the cams (2, 3) having different cam contours, a drag lever system (4), having a first lever (5), a second lever (7) which is connected to the first lever (5) such that it can be rotated about a pivot point (6), and a third lever (8) which is connected fixedly to the first lever (5), the first lever (5) having a roller pickup (15) for a first cam (2) and the second lever (7) having a roller pickup (17) for the second cam (3), the third lever (8) having a slotted guide (9) for the rectilinear positive guidance of a valve (30), the drag lever system (4) being mounted at the pivot point (6) such that it can be adjusted on a circular path (10) about the rotational axis (21) of the camshaft (20) in a cylinder block or cylinder head of the internal combustion engine, and having a play compensation element (11) between the second lever (7) and the first lever (5) or the third lever (8) for play compensation and for limiting the rotatability of the second lever (7) with respect to the first lever (5) and the third lever (8).

12. The internal combustion engine as claimed in claim 11, wherein the drag lever system (4) is configured in such a way that the valve lift of the valve (30) can be changed in a fully variable manner by way of an adjustment of the drag lever system (4) on a circular path (10).

13. The internal combustion engine as claimed in claim 11, wherein the cams (2, 3) and the drag lever system (4) are configured and adapted to one another in such a way that, in order to open the valve (30), the valve (30) can be moved away from the camshaft (20) by way of the first cam (2) and the drag lever system (4) and, in order to close the valve (30), can be moved back in the direction of the camshaft (20) by way of the second cam (3) and the drag lever system (4).

14. The internal combustion engine as claimed in claim 11, wherein the slotted guide (9) of the third lever (8) is configured in such a way that the valve (30) can be guided with a small play.

15. The internal combustion engine as claimed in claim 11, wherein a driver (12) is held guidably in the slotted guide (9), to which driver (12) the valve (30) can be fastened.

16. The internal combustion engine as claimed in claim 11, wherein the third lever (8) is configured as a forked lever.

17. The internal combustion engine as claimed in claim 11, wherein the first lever (5) and the third lever (8) are configured in one piece, in particular monolithically.

18. The internal combustion engine as claimed in claim 11, wherein the play compensation element (11) is a hydraulic play compensation element.

19. The internal combustion engine as claimed in claim 11, wherein the valve control means has a variable valve closing and opening time setting apparatus.

20. The internal combustion engine as claimed in claim 11, wherein the roller pickup (15) has a roller (16), and in that the lever (5) and the cam (2) can be arranged with respect to one another in such a way that there is a small play between the roller (16) and the cam (2).

* * * * *